US008179410B2

(12) United States Patent
Inoue

(10) Patent No.: US 8,179,410 B2
(45) Date of Patent: May 15, 2012

(54) PAPER SHEET SENSOR ADJUSTING METHOD

(75) Inventor: Yoshimasa Inoue, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 261 days.

(21) Appl. No.: 12/714,775

(22) Filed: Mar. 1, 2010

(65) Prior Publication Data

US 2010/0238253 A1 Sep. 23, 2010

(30) Foreign Application Priority Data

Mar. 17, 2009 (JP) ..... 2009-065020

(51) Int. Cl.
*G06K 7/00* (2006.01)
*B65H 7/14* (2006.01)
*B41J 11/42* (2006.01)

(52) U.S. Cl. ..... 347/218; 250/559.1; 250/206

(58) Field of Classification Search ..... 347/218; 250/559.1, 559.4, 206
See application file for complete search history.

(56) References Cited

U.S. PATENT DOCUMENTS

| | | | | |
|---|---|---|---|---|
| 6,348,697 | B1 * | 2/2002 | Kitajima | 250/559.4 |
| 6,720,544 | B2 * | 4/2004 | Barna et al. | 250/205 |
| 7,866,903 | B2 * | 1/2011 | Hatada et al. | 400/76 |
| 2003/0031476 | A1 * | 2/2003 | Takeuchi et al. | 399/16 |

FOREIGN PATENT DOCUMENTS

| | | |
|---|---|---|
| JP | 10-007120 | 1/1998 |
| JP | 2008-013289 | 1/2008 |

* cited by examiner

*Primary Examiner* — Huan Tran
(74) *Attorney, Agent, or Firm* — Turocy & Watson, LLP

(57) ABSTRACT

In a state where a sheet exists, an current I is gradually increased. When an voltage V reaches a light receiving level Vx, the current I at the time is stored as I1. The voltage V immediately before the voltage V reaches the light receiving level Vx is stored as V1. In a state where no sheet exists, the current I is gradually decreased from the above I1. When the voltage V reaches a non-light receiving level Vy, the current I at the time is stored as I2. The voltage V immediately before the voltage V reaches the non-light receiving level Vy is stored as V2. Then, the current I at the time of normal operation is set within a range between I1 and I2. A reference voltage Vs is set within a range between V1 and V2.

12 Claims, 4 Drawing Sheets

PAPER SHEET SENSOR ADJUSTING METHOD

CROSS REFERENCE TO RELATED APPLICATION

This application is based upon and claims the benefit of priority from prior Japanese Patent Application No. 2009-065020, filed Mar. 17, 2009, the entire contents of which are incorporated herein by reference.

TECHNICAL FIELD

A disclosed embodiment of the present invention relates to a method for adjusting a paper sheet sensor which optically detects a paper sheet.

BACKGROUND

A printer which performs printing on a paper sheet has a paper sheet sensor which optically detects a paper sheet. This paper sheet sensor includes a light emitting element and a light receiving element facing each other across a paper sheet carrying path. An output voltage of the light receiving element changes in accordance with whether light emitted from the light emitting element reaches the light receiving element or not.

That is, if there is no paper sheet between the light emitting element and the light receiving element, light from the light emitting element reaches the light receiving element and the output voltage of the light receiving element turns to a light receiving level. When a paper sheet enters between the light emitting element and the light receiving element, light from the light emitting element is interrupted by the paper sheet and does not reach the light receiving element. Thus, the output voltage of the light receiving element turns to a non-light receiving level.

For example, JP-A-2008-13289 discloses an apparatus having such a paper sheet sensor.

Detection targets of the paper sheet sensor include papers of various paper qualities and thicknesses such as thermal sheet, passbook, and normal paper. Depending on paper quality and thickness, light from the light emitting element may be transmitted through the paper sheet and reach the light receiving element. In such case, the output voltage of the light receiving element turns to the light receiving level despite the presence of the paper sheet between the light emitting element and the light receiving element. Thus, a detection error occurs indicating that there is no paper sheet.

SUMMARY

According to an aspect of the invention, a method for adjusting a paper sheet sensor includes:

in a state where a paper sheet exists between a light emitting element and a light receiving element, gradually increasing an operating current I of the light emitting element;

when an output voltage V of the light receiving element reaches a light receiving level Vx during the increase in the operating current I, storing the operating current I at the time as I1;

storing, as V1, the output voltage V of the light receiving element immediately before the output voltage V of the light receiving element reaches the light receiving level Vx;

in a state where the paper sheet does not exist between the light emitting element and the light receiving element, gradually decreasing the operating current I of the light emitting element from the above I1;

when the output voltage V of the light receiving element reaches a non-light receiving level Vy during the decrease in the operating current I, storing the operating current I at the time as I2;

storing, as V2, the output voltage V of the light receiving element immediately before the output voltage V of the light receiving element reaches the non-light receiving level Vy; and setting the operating current I at the time of normal operation of the light emitting element within a range between the above I1 and I2, and setting a reference voltage Vs for paper sheet detection with respect to the output voltage V of the light receiving element within a range between the above V1 and V2.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate presently embodiments of the invention, and together with the general description given above and the detailed description of the preferred embodiments given below, serve to explain the principles of the invention.

DETAILED DESCRIPTION

Hereinafter, an embodiment of the invention will be described with reference to the drawings.

Figure 1:
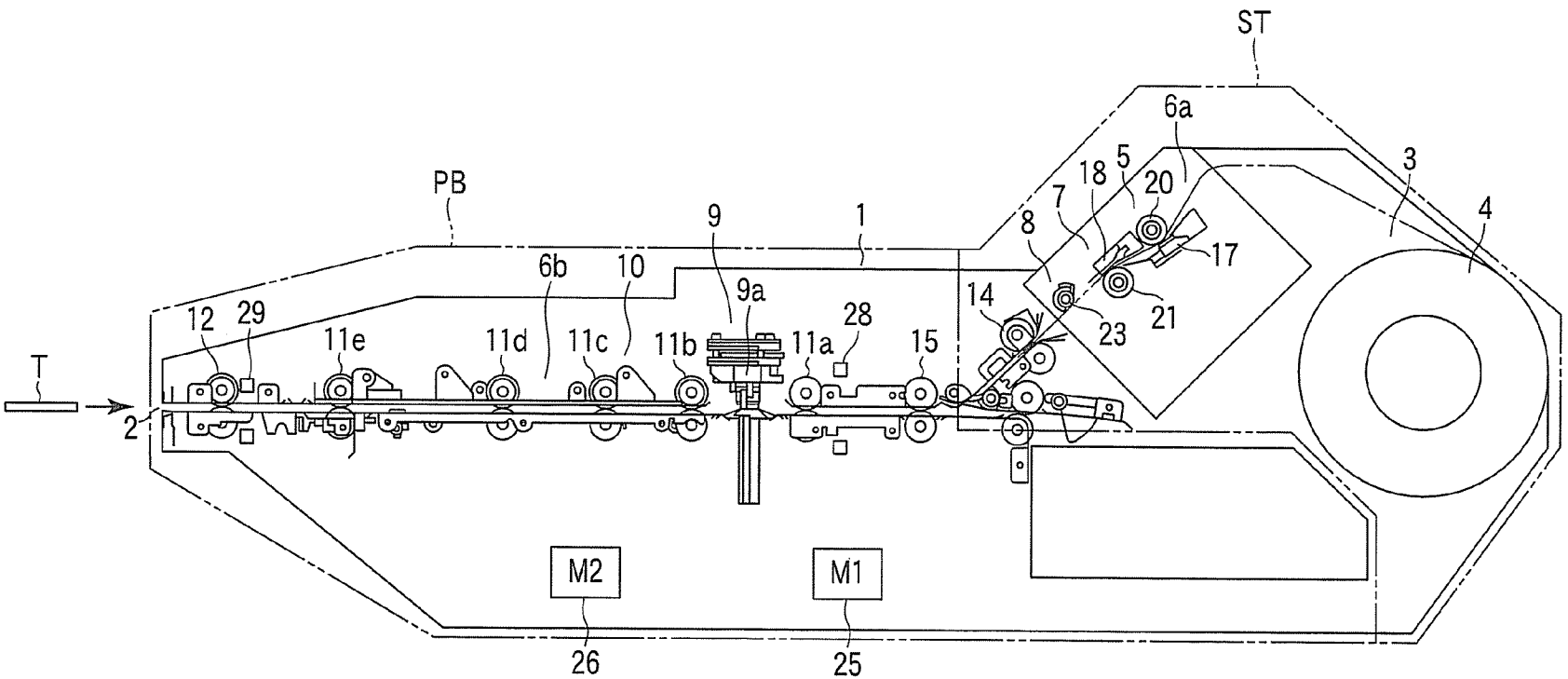
FIG. 1 shows the overall configuration of an embodiment.

As shown in FIG. 1, a printer 1 has on its front side a fascia section 2 which functions both as an entrance and exit of a passbook T and as an exit of a statement sheet. The printer 1 also has on its rear side a sheet setting section 3 for setting a rolled thermal sheet 4.

A first carrying unit 5 pulls out the forward edge of the set thermal sheet 4 and guides the thermal sheet 4 to a carrying path 6*a*. On this carrying path 6*a*, a thermal print section 7 and a cutting section 8 are provided.

Following the first carrying unit 5, a second carrying unit 10 is provided. The second carrying unit 10 has a carrying path 6*b* which connects to the carrying path 6*a*, and carrying rollers 11*a* to 11*e*, entrance and exit rollers 12 and feed rollers 15 provided along the carrying path 6*b*. The second carrying unit 10 carries the passbook T inserted into the fascia section 2 and also carries the thermal sheet 4 sent from the carrying path 6*a* toward the fascia section 2.

A dot print section 9 is arranged between the carrying rollers 11*a* and 11*b* in the carrying path 6*b*. The dot print section 9 has a 24-pin dot matrix head 9*a*. The entrance and exit rollers 12 take in the passbook T inserted in the fascia section 2 and also send the printed passbook T and statement sheet out of the fascia section 2.

A sheet sensor 28 as a paper sheet sensor is provided on the thermal sheet introducing side of the second carrying unit 10. The sheet sensor 28 has a light emitting element and a light receiving element and optically detects the thermal sheet 4 as a print target paper sheet. A passbook sensor 29 as a paper sheet sensor is provided near the entrance and exit rollers 12 in the second carrying unit 10. The passbook sensor 29 has a light emitting element and a light receiving element and optically detects a page space of the passbook T as a print target paper sheet.

The thermal print section 7 has a thermal head 17 for back-side print and a thermal head 18 for face-side print at positions with a predetermined space along the direction of carrying the thermal sheet 4. Platen rollers 20 and 21 are rotatably pressed in contact with the thermal heads 17 and 18. The thermal head 17 prints information on one side of the thermal sheet 4 while nipping and carrying the thermal sheet 4 together with the platen roller 20. The thermal head 18 prints information on the other side of the thermal sheet 4 while nipping and carrying the thermal sheet 4 together with the platen roller 21.

The cutting section 8 has a rotary cutter 23 and cuts the thermal sheet 4 as the rotary cutter 23 rotates. The cut piece serves as a statement sheet. Feed rollers 14 send the statement sheet to the second carrying unit 10.

A motor 25 is provided to drive the platen rollers 20 and 21, the rotary cutter 23 and the feed rollers 14. A motor 26 is provided to drive the carrying rollers 11*a* to 11*e*, the entrance and exit rollers 12 and the feed rollers 15.

The sheet setting section 3, the first carrying unit 5 and their peripheral part constitute a statement printer ST. The statement printer ST prints information on the thermal sheet 4 while carrying the thermal sheet 4.

The feed rollers 15, the second carrying unit 10 and their peripheral part constitute a passbook printer PB. The passbook printer PB prints information on the passbook T while carrying the passbook T. The passbook printer PB carries the thermal sheet 4 when the statement printer ST performs printing.

Figure 2:
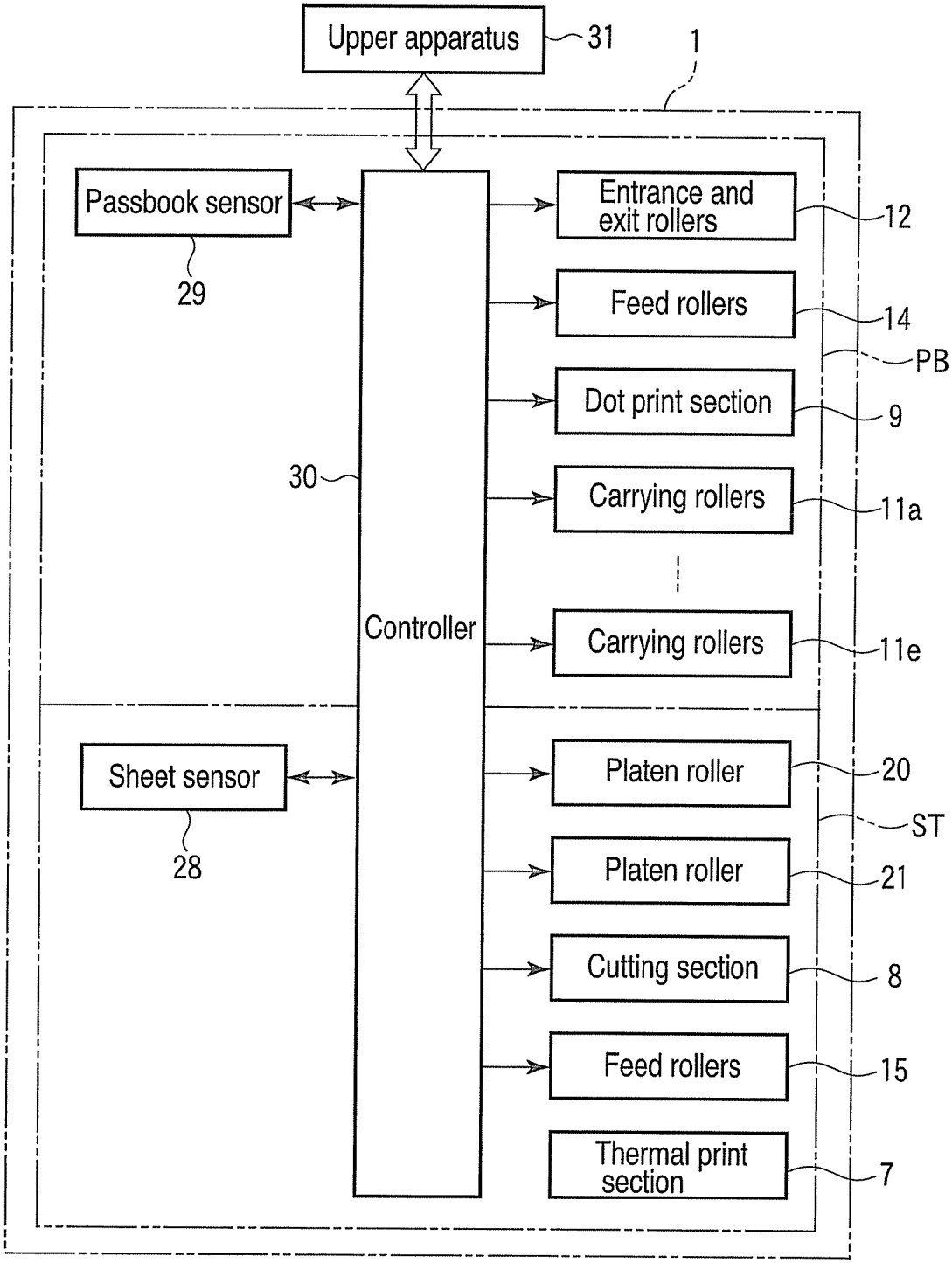
FIG. 2 is a block diagram showing a control circuit according to the embodiment.

FIG. 2 shows a control circuit.

A controller 30 is provided to control the statement printer ST and to control the passbook printer PB. Components of the statement printer ST and components of the passbook printer PB are connected to the controller 30. Moreover, an upper apparatus 31 is connected to the controller 30.

Figure 3:
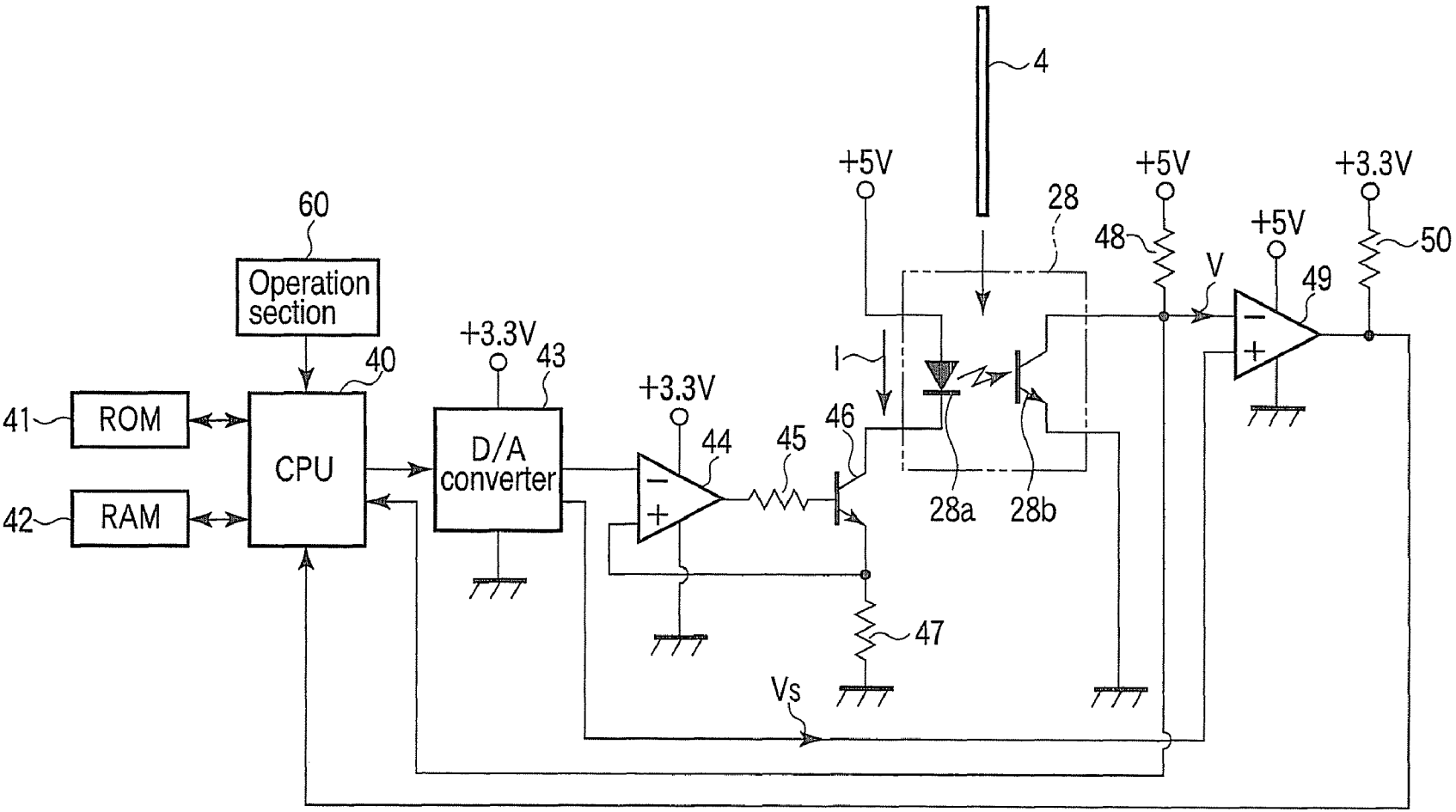
FIG. 3 is a block diagram showing the configuration of a sheet sensor and its peripheral circuit according to the embodiment.

The controller 30 has a sensor circuit shown in FIG. 3 to control driving of the sheet sensor 28. That is, a ROM 41 for storing a control program, a RAM 42 for storing data, a digital-analog (D-A) converter 43 to output a driving signal to the sheet sensor 28, and an operation section 60 to operate a driving signal to the sheet sensor 28 are connected to a CPU 40. The D-A converter 43 outputs a DC voltage for setting an operating current to the sheet sensor 28 in accordance with a command from the CPU 40 and outputs a reference voltage Vs for sheet detection in accordance with a command from the CPU 40. The DC voltage for setting an operating current is amplified by an operational amplifier 44 and then applied between the base and emitter of an NPN transistor 46 via a resistor 45.

The sheet sensor 28 has a light emitting element, for example, a light emitting diode 28*a*, and a light receiving element, for example, a phototransistor 28*b*, facing each other across the carrying path 6*b* on which the thermal sheet 4 is carried. The anode of the light emitting diode 28*a* is connected to the positive terminal of a DC voltage 5 V. The cathode of the light emitting diode 28*a* is earthed via between the collector and emitter of the transistor 46 and a resistor 47. The collector of the phototransistor 28*b* is connected to the positive terminal of a DC voltage 5 V via a resistor 48. The emitter of the phototransistor 28*b* is earthed. A voltage generated at the collector of the phototransistor 28*b* is inputted to the negative input terminal of a comparator 49 and to the CPU 40, as an output voltage V of the phototransistor 28*b*.

The reference voltage Vs outputted from the CPU 40 is inputted to the positive input terminal of the comparator 49. The output terminal of the comparator 49 is connected to the positive terminal of a DC voltage 3.5 V via a resistor 50. The mutual connection point between the output terminal of the comparator 49 and the resistor 50 is connected to the CPU 40. The comparator 49 compares the output voltage V of the phototransistor 28*b* with the reference voltage Vs, and outputs a low-level voltage signal indicating the existence of the thermal sheet 4 when the output voltage V is lowered to or below the reference voltage Vs.

Next, a method for adjusting the sheet sensor 28 will be described.

Figure 4:
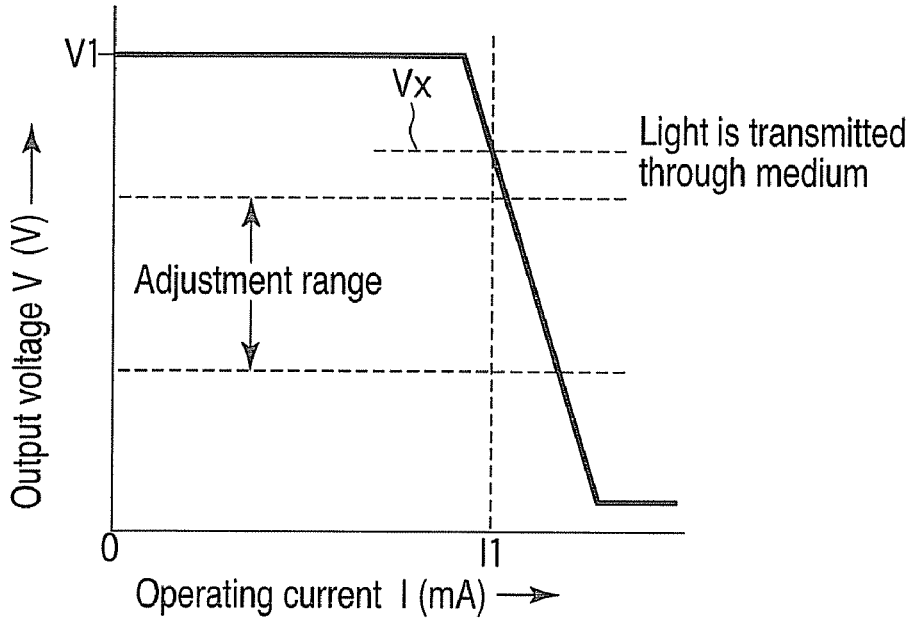
FIG. 4 shows change in output voltage V of a light receiving element along with increase in operating current I of a light emitting element according to the embodiment.

First, the thermal sheet 4 is set between the light emitting diode 28*a* and the phototransistor 28*b*. Then, an adjustment mode is set by the operation of the operation section 60. Thus, a DC voltage for setting an operating current is outputted from the D-A converter 43 in accordance with a command from the CPU 40 to the D-A converter 43. This DC voltage for setting an operating current gradually increases in voltage level. The DC voltage is then amplified by the operational amplifier 44 and applied between the base and emitter of the transistor 46. The transistor 46 increases in degree of continuity as the applied voltage between the base and emitter increases. As the degree of continuity of the transistor 46 increases, the operating current I flowing through the light emitting diode 28*a* gradually increases from zero. FIG. 4 shows change in the output voltage V of the phototransistor 28*b* due to the increase in the operating current I.

That is, as the operating current I flowing through the light emitting diode 28*a* gradually increases from zero, the quantity of light emission from the light emitting diode 28*a* increases. As the quantity of light emission increases, the light is eventually transmitted through the thermal sheet 4. The transmitted light reaches the phototransistor 28*b*.

Before the light is transmitted through the thermal sheet 4, the phototransistor 28*b* does not receive the light and turns off. At this time, the output voltage V of the phototransistor 28*b* maintains a high level. This output voltage V is higher than the reference voltage Vs. Therefore, the output of the comparator 49 is at a low level.

When the light transmitted through the thermal sheet 4 reaches the phototransistor 28*b*, the phototransistor 28*b* turns on. As the phototransistor 28*b* turns on, the output voltage V of the phototransistor 28*b* falls. When this output voltage V becomes equal to or lower than the reference voltage Vs, the output of the comparator 49 turns to a high level.

The CPU 40 monitors the output voltage V of the comparator 49. When the output voltage V starts falling and reaches a predetermined light receiving level Vx, the CPU 40 grasps the operating current I at the time from the output control of the DC voltage for setting the operating current. The CPU 40 stores the grasped operating current I in the RAM 42 as I1. The CPU 40 also stores the output voltage V immediately before the output voltage V reaches the light receiving level Vx in the RAM 42 as V1.

Figure 5:
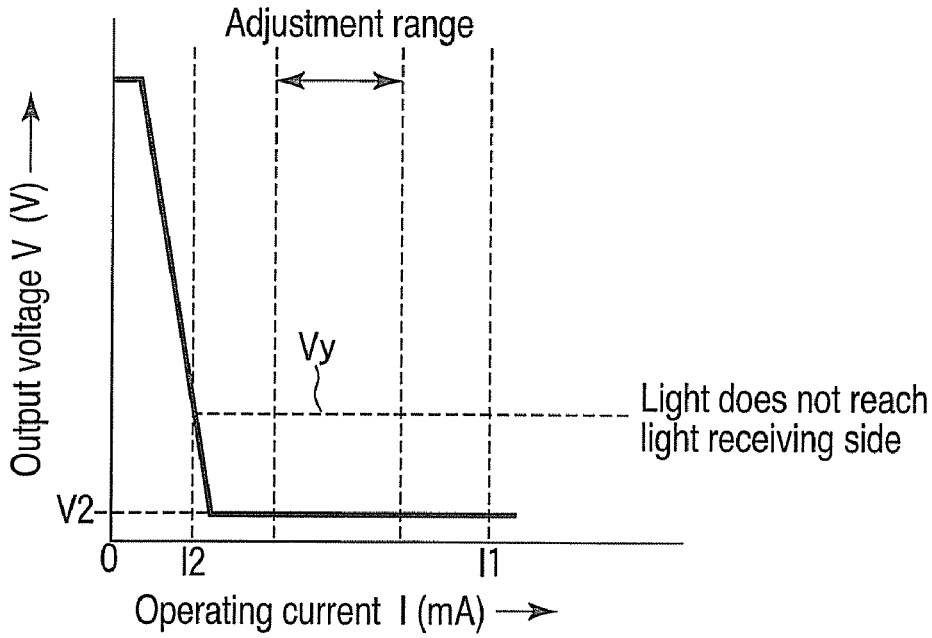
FIG. 5 shows change in output voltage V of the light receiving element along with decrease in operating current I of the light emitting element according to the embodiment.

Next, the thermal sheet 4 is removed from between the light emitting diode 28*a* and the phototransistor 28*b*. In this state, the continuation of the adjustment mode is set by the operation of the operation section 60. Then, the DC voltage for setting the operating current, outputted from the D-A converter 43, gradually decreases in accordance with a command from the CPU 40 to the D-A converter 43. Together with this decrease, the degree of continuity of the transistor 46 is reduced and the operating current I flowing through the light emitting diode 28*a* gradually decreases. FIG. 5 shows change in the output voltage V of the phototransistor 28*b* due to the decrease in the operating current I.

That is, as the operating current I flowing through the light emitting diode 28*a* gradually decreases, the quantity of light emission from the light emitting diode 28*a* decreases. As the quantity of light emission decreases, the light eventually stops reaching the phototransistor 28*b*.

While the light reaches the phototransistor 28*b*, the phototransistor 28*b* is on and the output voltage of the phototransistor 28*b* maintains a low level.

When the light does not reach the phototransistor 28*b* any longer, the phototransistor 28*b* turns off and the output voltage of the phototransistor 28*b* turns to a high level.

When the output voltage V starts rising and reaches a predetermined non-light receiving level Vy, the CPU 40 grasps the operating current I at the time from the output control of the DC voltage for setting the operating current. The CPU 40 stores the grasped operating current I in the RAM 42 as I2. The CPU 40 also stores the output voltage V immediately before the output voltage V reaches the non-light receiving level Vy in the RAM 42 as V2.

After storing the above I1, V1, I2 and V2, the CPU 40 sets the operating current I at the time of normal operation of the light emitting diode 28*a* within the range between I1 and I2 and also set the reference voltage Vs for sheet detection with respect to the output voltage V of the phototransistor 28*b* within the range between V1 and V2. Specifically, the operating current I at the time of normal operation of the light emitting diode 28*a* is set at (I1+I2)/2, which is the intermediate value between I1 and I2, and the reference voltage Vs for sheet detection with respect to the output voltage V of the phototransistor 28*b* is set at (V1+V2)/2, which is the intermediate value between V1 and V2.

With this setting, it is possible to appropriately determine whether the thermal sheet 4 exists between the light emitting diode 28*a* and the phototransistor 28*b* or not, irrespective of the paper quality and thickness of the thermal sheet 4.

The CPU 40 registers data of the operating current I at the time of normal operation and the reference voltage Vs for sheet detection that are set, in a sheet database in the RAM 42 in association with the type, name, model number and the like of the thermal sheet 4 that is set at the time of setting the adjustment mode. With this registration, the adjustment mode ends.

In the sheet database, operating currents I and reference voltages Vs corresponding to plural paper sheets including various thermal sheets 4 can be registered.

Normally, when a specific paper sheet is designated from the upper apparatus 31, the CPU 40 reads out the operating current I and the reference voltage Vs corresponding to the designated paper sheet from the sheet database and sets these operating current I and reference voltage Vs to the sheet sensor 28. Therefore, even in a situation where various paper sheets of different thicknesses such as passbook, thermal sheet and normal paper are used as detection targets of the sheet sensor 28, it is possible to constantly detect a paper sheet appropriately without any detection error.

In the embodiment, only the adjustment of the sheet sensor 28 is described. However, the adjustment of the passbook sensor 29 can be similarly carried out. That is, the CPU 40 stores I1, V1, I2 and V2 as described above, and then sets the operating current I at the time of normal operation of the light emitting diode as the light emitting element within the range between I1 and I2 and also sets the reference voltage Vs for passbook detection with respect to the output voltage V of the phototransistor as the light receiving element within the range between V1 and V2. Specifically, the operating current I at the time of normal operation of the light emitting diode is set at (I1+I2)/2, which is the intermediate value between I1 and I2, and the reference voltage Vs for sheet detection with respect the output voltage V of the phototransistor is set at (V1+V2)/2, which is the intermediate value between V1 and V2.

With this setting, it is possible to appropriately detect whether a page space of the passbook T exists between the light emitting diode and the phototransistor or not, irrespective of the paper quality and thickness of the page space of the passbook T.

The CPU 40 registers data of the operating current I at the time of normal operation and the reference voltage Vs for sheet detection that are set, in the sheet database in the RAM 42 in association with the type, name, model number and the like of the passbook T that is set at the time of setting the adjustment mode. With this registration, the adjustment mode ends.

In the embodiment, the printer including the statement printer ST and the passbook printer PB is described as an example. However, the invention is not limited to this embodiment and can be similarly applied to any other device or machine having a paper sheet sensor that optically detects a paper sheet, such as a copier or facsimile machine.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A method for adjusting a paper sheet sensor which optically detects a paper sheet using a light emitting element and a light receiving element, the method comprising:

in a state where the paper sheet exists between the light emitting element and the light receiving element, gradually increasing an operating current I of the light emitting element;

when an output voltage V of the light receiving element reaches a light receiving level Vx during the increase in the operating current I, storing the operating current I at the time as I1;

storing, as V1, the output voltage V of the light receiving element immediately before the output voltage V of the light receiving element reaches the light receiving level Vx;

in a state where the paper sheet does not exist between the light emitting element and the light receiving element, gradually decreasing the operating current I of the light emitting element from the above I1;

when the output voltage V of the light receiving element reaches a non-light receiving level Vy during the decrease in the operating current I, storing the operating current I at the time as I2;

storing, as V2, the output voltage V of the light receiving element immediately before the output voltage V of the light receiving element reaches the non-light receiving level Vy; and setting the operating current I at the time of normal operation of the light emitting element within a range between the above I1 and I2, and setting a reference voltage Vs for paper sheet detection with respect to the output voltage V of the light receiving element within a range between the above V1 and V2.

2. The method of claim 1, wherein in the setting, the operating current I at the time of normal operation of the light emitting element is set at (I1+I2)/2, which is an intermediate value between the above I1 and the above I2, and the reference voltage Vs for paper sheet detection with respect to the output voltage V of the light receiving element is set at (V1+V2)/2, which is an intermediate value between the above V1 and V2.

3. The method of claim 1, wherein the light emitting element and the light receiving element face each other across a carrying path of the paper sheet.

4. The method of claim 1, wherein the paper sheet is a thermal sheet or passbook.

5. The method of claim 4, wherein the paper sheet sensor is a sheet sensor which optically detects the thermal sheet and a passbook sensor which optically detects the passbook.

6. The method of claim 5, wherein the light emitting element and the light receiving element of the sheet sensor face each other across a carrying path of the thermal sheet, and the light emitting element and the light receiving element of the passbook sensor face each other across a carrying path of the passbook.

7. A method for adjusting a paper sheet sensor in a printer having a paper sheet sensor which optically detects a paper sheet, the method comprising:

in a state where the paper sheet exists between a light emitting element and a light receiving element, gradually increasing an operating current I of the light emitting element;

when an output voltage V of the light receiving element reaches a light receiving level Vx during the increase in the operating current I, storing the operating current I at the time as I1;

storing, as V1, the output voltage V of the light receiving element immediately before the output voltage V of the light receiving element reaches the light receiving level Vx;

in a state where the paper sheet does not exist between the light emitting element and the light receiving element, gradually decreasing the operating current I of the light emitting element from the above I1;

when the output voltage V of the light receiving element reaches a non-light receiving level Vy during the decrease in the operating current I, storing the operating current I at the time as I2;

storing, as V2, the output voltage V of the light receiving element immediately before the output voltage V of the light receiving element reaches the non-light receiving level Vy; and setting the operating current I at the time of normal operation of the light emitting element within a range between the above I1 and I2, and setting a reference voltage Vs for paper sheet detection with respect to the output voltage V of the light receiving element within a range between the above V1 and V2.

8. The method of claim 7, wherein in the setting, the operating current I at the time of normal operation of the light emitting element is set at (I1+I2)/2, which is an intermediate value between the above I1 and the above I2, and the reference voltage Vs for paper sheet detection with respect to the output voltage V of the light receiving element is set at (V1+V2)/2, which is an intermediate value between the above V1 and V2.

9. The method of claim 7, wherein the printer prints information on the paper sheet while carrying the paper sheet.

10. The method of claim 7, wherein the printer is a statement printer which prints information on a thermal sheet while carrying the thermal sheet and a passbook printer which prints information on a passbook while carrying the passbook.

11. The method of claim 10, wherein the paper sheet sensor is a sheet sensor which optically detects the thermal sheet and a passbook sensor which optically detects the passbook.

12. The method of claim 11, wherein the light emitting element and the light receiving element of the sheet sensor face each other across a carrying path of the thermal sheet, and the light emitting element and the light receiving element of the passbook sensor face each other across a carrying path of the passbook.

* * * * *